US008950464B2

(12) United States Patent
Hendriks

(10) Patent No.: US 8,950,464 B2
(45) Date of Patent: Feb. 10, 2015

(54) PANEL CURTAIN SYSTEM WITH IMPROVED OPERATING RUNNER

(75) Inventor: Wouter Hendriks, Enschede (NL)

(73) Assignee: Coulisse B.V., Enter (NL)

( * ) Notice: Subject to any disclaimer, the term of this patent is extended or adjusted under 35 U.S.C. 154(b) by 555 days.

(21) Appl. No.: 13/127,558

(22) PCT Filed: Nov. 5, 2009

(86) PCT No.: PCT/NL2009/050667

§ 371 (c)(1),
(2), (4) Date: Jun. 28, 2011

(87) PCT Pub. No.: WO2010/053361

PCT Pub. Date: May 14, 2010

(65) Prior Publication Data

US 2011/0259531 A1 Oct. 27, 2011

(30) Foreign Application Priority Data

Nov. 6, 2008 (NL) ..... 2002181

(51) Int. Cl.

| | |
|---|---|
| ***A47H 5/032*** | (2006.01) |
| ***A47H 1/04*** | (2006.01) |
| ***A47H 3/02*** | (2006.01) |
| *A47H 23/02* | (2006.01) |

(52) U.S. Cl.

CPC ..... *A47H 5/032* (2013.01); *A47H 1/04* (2013.01); *A47H 3/02* (2013.01); *A47H 5/0325* (2013.01); *A47H 2001/047* (2013.01); *A47H 2023/025* (2013.01)

USPC ..... 160/331; 160/345

(58) Field of Classification Search

USPC ..... 160/331, 345, 168.1 V, 168.1 P, 173 V, 160/168.1 R; 16/87.4 R, 95 D

See application file for complete search history.

(56) References Cited

U.S. PATENT DOCUMENTS

| | | | | | |
|---|---|---|---|---|---|
| 2,097,907 | A | * | 11/1937 | Allen | 160/345 |
| 3,153,942 | A | * | 10/1964 | Staak | 74/425 |
| 3,192,995 | A | * | 7/1965 | Graber et al. | 160/345 |
| 3,297,078 | A | * | 1/1967 | Miki | 160/331 |
| 3,354,498 | A | * | 11/1967 | Salzmann | 16/87.4 R |
| 3,424,225 | A | * | 1/1969 | Magnusson | 160/345 |
| 3,427,679 | A | * | 2/1969 | Znamirowski | 16/93 D |
| 3,514,806 | A | * | 6/1970 | Klein | 16/94 R |
| 3,738,414 | A | * | 6/1973 | Baker, Sr. | 160/345 |
| 3,978,904 | A | * | 9/1976 | Riebock et al. | 160/345 |
| 4,683,935 | A | * | 8/1987 | Arquati | 160/331 |

FOREIGN PATENT DOCUMENTS

| | | |
|---|---|---|
| DE | 3137769 A1 | 9/1981 |
| FR | 80 21558 | 10/1980 |
| GB | 2106771 | 4/1983 |
| NL | 2001072 | 12/2007 |
| NL | 20001072 | 12/2007 |
| NL | 2000618 | 10/2008 |
| SE | PCT/SE2005/000020 | 7/2005 |

* cited by examiner

*Primary Examiner* — David Purol

(74) *Attorney, Agent, or Firm* — Jensen & Puntigam, PS

(57) ABSTRACT

A panel curtain system including a number of panels guided by a rail, a control cord endlessly secured to the panels and at least one operating runner secured to at least one panel and securing the control cord. The panel curtain system includes a motorized drive for the at least one control cord and a means tensioning element for tensioning the control cord.

5 Claims, 3 Drawing Sheets

PANEL CURTAIN SYSTEM WITH IMPROVED OPERATING RUNNER

TECHNICAL FIELD

The invention relates to a panel curtain system, comprising a number of panels and a rail for guiding the panels, a control cord fastened endlessly to the panels, and at least one operating runner which is adapted for guiding in the rail and which is provided with means for attaching to at least one of the panels and with means for fastening the control cord.

BACKGROUND OF THE INVENTION

Such a panel curtain system is known in practice. One or two known operating runners are mounted herein on one or both sides of the panel curtain, which is formed by one or more panels. The outer ends of the control cord are fastened to the operating runner(s). This generally takes place by means of a simple screw connection. An endless cord is in this way realized which is intended for manual operation of the panel curtain. In the relevant field the known operating runner is also referred to as cord carriage.

SUMMARY OF THE INVENTION

The invention has for its object to provide a panel curtain system of the type stated in the preamble with automated operation.

The panel curtain system according to the invention has for this purpose the feature that the panel curtain system comprises a motorized drive for the at least one control cord and that the operating runner comprises a tensioning element for tensioning the control cord in the situation of use of the panel curtain system.

In contrast to that in a manually operated panel curtain system, the control cord in an automated panel curtain system is wholly received in the rail and therefore no longer accessible from outside. By applying the operating runner according to the invention the control cord can also be tensioned in advantageous manner in the situation of use of the panel curtain system, i.e. after being mounted. This is of essential importance for a proper functioning of the motorized drive.

In a first preferred embodiment the tensioning element is adapted for receiving in one of the runner channels of the rail of the panel curtain system. The tensioning element is hereby accessible to a user via the longitudinal opening for the runners which is provided in the runner channels on the underside of the rail.

In an elegant preferred embodiment with improved convenience of use the tensioning element is adapted to receive one of the outer ends of the control cord in releasably clamping manner. The control cord can hereby be brought to the desired tension in simple manner.

In a practical preferred embodiment the operating runner is provided with a central part which is provided on one side with a guide element adapted for guiding in one of the runner channels of the rail, this guide element comprising the tensioning element.

An easy and reliable operation is achieved in a further development in which the tensioning element comprises a recess for receiving a first outer end of the control cord, this recess being adapted to clamp the control cord. According to the further development hereof, the recess is provided with a narrowed portion for further clamping of the control cord.

According to another preferred embodiment, an endless control cord can be realized in practical manner with one operating runner in that the guide element also comprises a further recess for receiving the other outer end of the control cord, this recess likewise being adapted to clamp the control cord.

Further advantageous embodiments of the panel curtain system according to the invention are described in further sub-claims.

The invention also relates to an operating runner as described as a component of a panel curtain system according to the invention.

BRIEF DESCRIPTION OF THE DRAWINGS

The invention will now be described in more detail with reference to the figures.

BEST MODE TO CARRY OUT THE INVENTION

Figure 1:
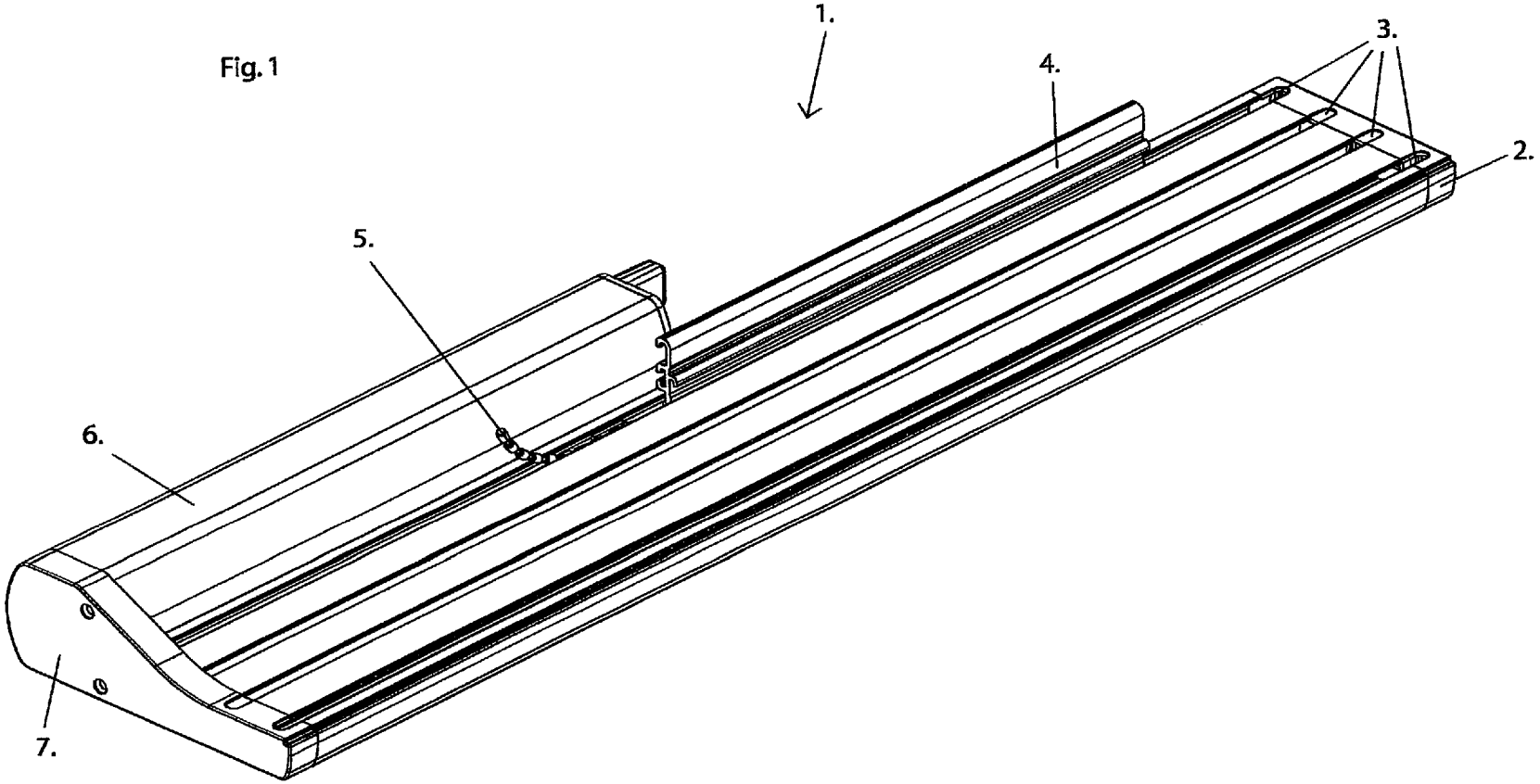
FIG. 1 shows schematically a preferred embodiment of a panel curtain system provided with an operating runner according to the invention.

FIG. 1 shows schematically a bottom view of a preferred embodiment of a panel curtain system 1 according to the invention. Panel curtain system comprises a rail 2 provided with a number of longitudinal openings 3 for receiving the runners of profiles 4. Profiles 4 can be operated by means of a control cord 5. Such a panel curtain system is known for instance from the Netherlands patent application NL 2001072 of the same applicant. The panels of the panel curtain are omitted for the sake of clarity.

In the shown preferred embodiment panel curtain system 1 is an automated panel curtain system which is provided with a motor accommodated in motor housing 6, which is mounted on rails 2 by means of a bracket 7.

Figure 2:
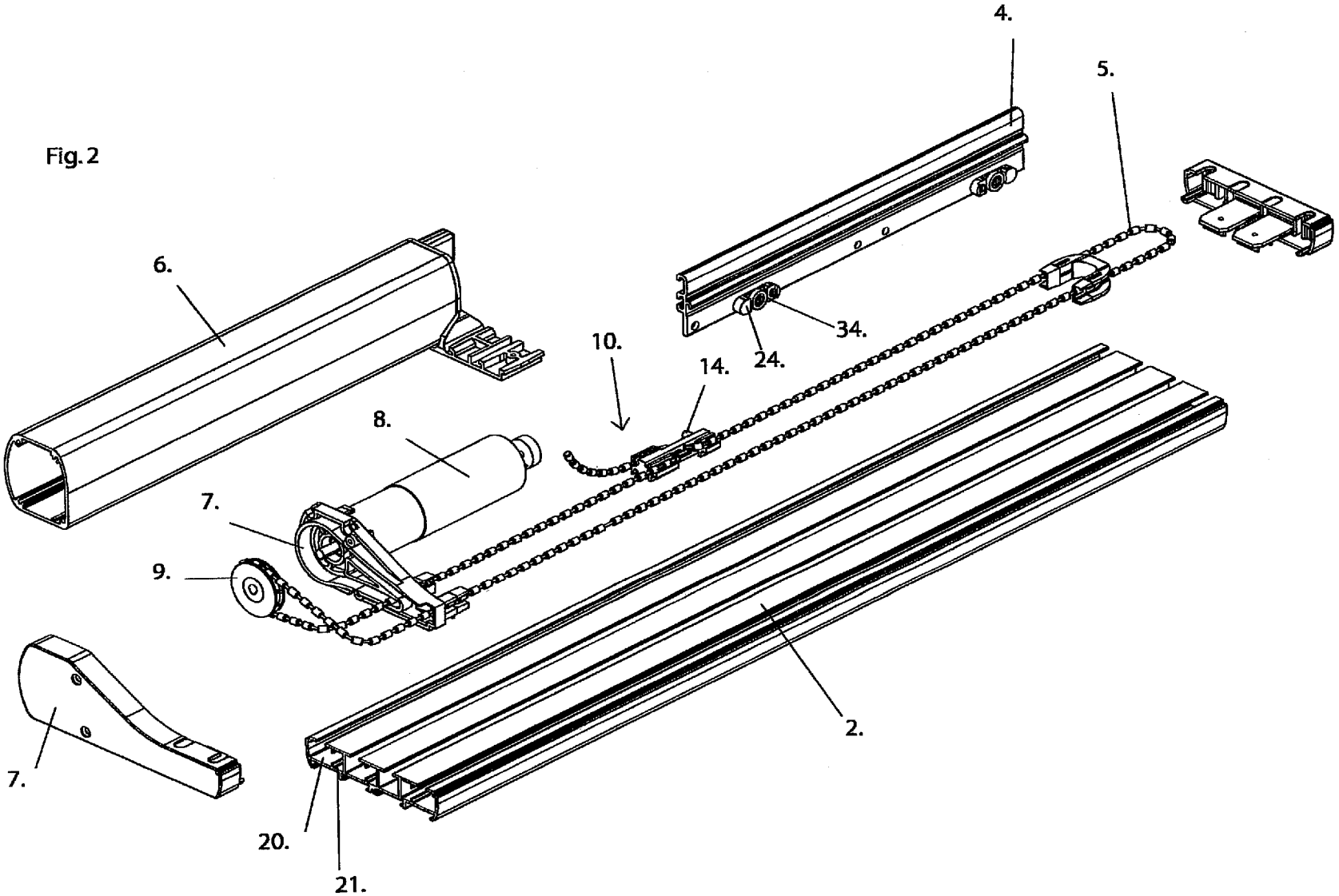
FIG. 2 shows an exploded view of the panel curtain system of FIG. 1.

FIG. 2 shows an exploded view of panel curtain system 1. Shown herein is a preferred embodiment of operating runner 10 according to the invention. Both outer ends of control cord 5 are fastened to operating runner 10 such that an endless cord is formed. The endless cord is driven by motor 8 by means of a drive wheel 9 over which control cord 5 is trained. In the shown preferred embodiment control cord 5 is a barrel chain. It will however be apparent that other forms of control cord can also be applied in the present invention, provided they are suitable for driving by means of a drive wheel and a motorized drive.

Operating runner 10 is provided with means for attaching to at least one of the panels. In the shown preferred embodiment the operating runner is adapted for direct attachment to profile 4, and more particularly to one of the runners 24 mounted on profile 4. Attachment preferably takes place via a so-called snap connection, for instance a pin-hole connection, wherein pin 14 is provided on operating runner 10 and co-acts with a hole 34 on runner 24.

Rail 2 is provided with runner channels 20 and cord channels 21. Runner channels 20 and cord channels 21 lie adjacently of each other. Runner channels 20 are intended for guiding runners 24. In the shown preferred embodiment runners 24 are mounted on the upper side of profiles 4, and profiles 4 protrude outward from rail 2 through longitudinal openings 3. Cord channels 21 extend adjacently of the runner channels. Cord channels 21 are intended for guiding of control cord 5. The operating runner known in practice is received in the cord channels of the rail of the known panel curtain system. Cord channels 21 are not provided with longitudinal openings and are consequently only accessible from the side of the rail. In most situations this means that cord channels 21 are wholly inaccessible in the mounted position of the panel curtain system.

Figure 3:
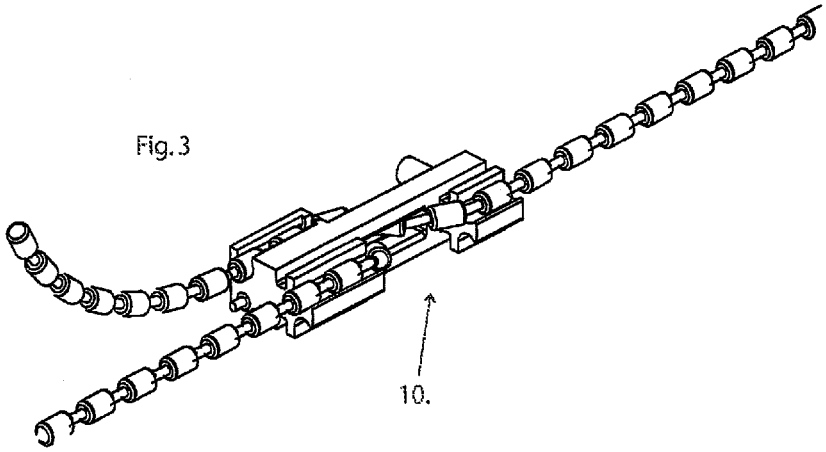
FIG. 3 shows schematically the operating runner of FIG. 1.

Operating runner 10 will be described in more detail with reference to FIGS. 3, 4 and 5.

Operating runner 10 is adapted according to the invention for guiding in one of the runner channels 20 and in one of the cord channels 21. Operating runner 10 is provided with a central part 11 provided on either side with guide elements. Guide elements 12 and 13 are intended for guiding in one of the cord channels 21. Provided on the opposite side of central part 11 is an additional guide element 15 which is adapted for guiding in one of the runner channels 20. Guide element 15 also serves as tensioning element for control cord 5. All guide elements 12, 13, 15 are provided with recesses 22, 23, respectively 25 and 45 for receiving control cord 5. Recesses 22 and 23 are adapted for passage of the control cord, while recesses 25 and 45 are adapted for fastening outer ends 5-1 and 5-2 of the control cord.

Figure 4:
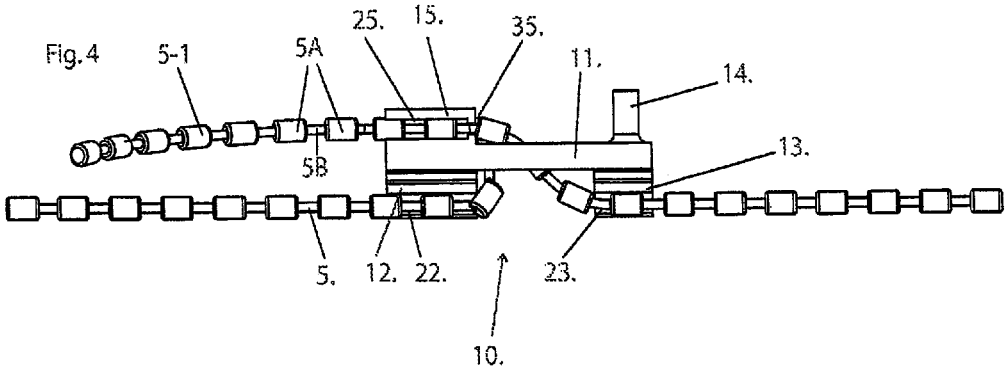
FIG. 4 shows a top view of the operating runner of FIG. 1.

FIG. 4 shows the upper side of guide element 15, which is provided with recess 25 with a narrowed portion 35 adjacently thereof. The dimensions of recess 25 correspond to the dimensions of barrels 5A. Recess 25 is adapted to clamp barrels 5A. The dimensions of narrowed portion 35 correspond to the dimensions of cord part 5B located between barrels 5A. The narrowed portion 35 is adapted to clampingly receive the part 5B of control cord 5. The upper side of guide element 15 with recess 25 and narrowed portion 35 is intended for placing adjacently of the longitudinal opening in runner channel 20. In the situation of use of the panel curtain system the outer end 5-1 protrudes from runner channel 20 and is accessible to a user. By grasping outer end 5-1 a user can release control cord 5 from operating runner 10 and adjust the tension on control cord 5 and subsequently refasten outer end 5-1 to the operating runner.

Figure 5:
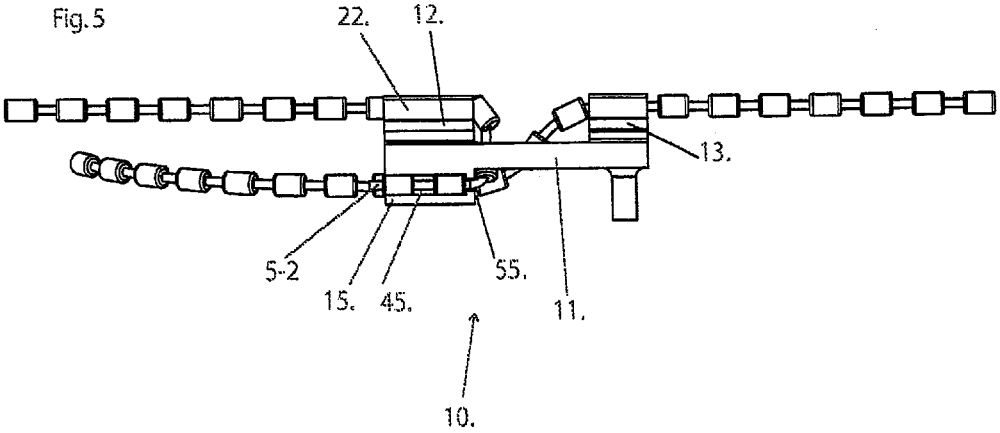
FIG. 5 shows a bottom view of the operating runner of FIG. 1.

FIG. 5 shows the underside of guide element 15, which is provided with means for receiving the other outer end 5-2 of control cord 5. These means comprise a recess 45 for clampingly receiving the barrels 5A and a narrowed portion 55 for clampingly receiving cord part 5B. The underside of guide element 15 is intended for placing adjacently of the closed side of runner channel 20. Outer end 5-2 is not accessible to a user.

Guide element 15 preferably takes a symmetrical form and recesses 25 and 45 are identical, as are narrowed portions 35 and 55. In this symmetrical embodiment the guide element can serve on both sides as tensioning element for the control cord.

The height of guide element 15 corresponds to the height of runner channel 20 and is chosen such that runner channel 20 guides guide element 15 fittingly. In similar manner the heights of guide elements 12 and 13 correspond to the height of cord channel 21 which guides guide elements 12 and 13 fittingly. Central part 11 has a smaller height. This creates the option of allowing control cord 5 to run through below central part 11 so as to thus realize an endless cord.

The invention is of course not limited to the described and shown preferred embodiments, but extends to any embodiment falling within the scope of protection as defined in the claims and seen in the light of the foregoing description and associated drawings.

The invention claimed is:

1. A panel curtain system (1), comprising a number of panels and a rail (2) for guiding the panels, a control cord (5) fastened endlessly to the panels, and at least one operating runner (10) which is adapted for guiding in the rail and which is provided with means for attaching to at least one of the panels and with means for fastening the control cord, characterized in that the panel curtain system comprises a motorized drive for the at least one control cord, the rail is provided with runner channels (20) for guiding runners (24) and with cord channels (21) for guiding of control cord (5), wherein the runner channels (20) and cord channels (21) lie adjacently of each other and that the operating runner (10) comprises a tensioning element (15) for tensioning the control cord in the situation of use of the panel curtain system, wherein the tensioning element (15) is adapted to receive one of the outer ends of the control cord in releasably clamping manner, wherein the operating runner (10) is provided with a central part (11) which is provided on one side with a guide element (15) adapted for guiding in one of the runner channels of the rail, this guide element (15) comprising the tensioning element, wherein the central part (11) is provided on the opposite side with at least one further guide element (12, 13) which is adapted for guiding in one of the cord channels (21) of the rail and for passage of the control cord (5), wherein the tensioning element (15) comprises a recess (25) for receiving a first outer end (5-1) of the control cord, this recess being adapted to clamp the control cord, wherein the operating runner (10) is wholly received in the rail (2) with said recess (25) running adjacently of the longitudinal opening for the runners provided in said runner channel allowing the outer end (5-1) to protrude from the runner channel (20) making it accessible to a user.

2. A panel curtain system as claimed in claim 1, wherein the recess is provided with a narrowed portion (35) for further clamping of the control cord.

3. A panel curtain system as claimed in claim 1, wherein the guide element also comprises a further recess (45) for receiving the other outer end (5-2) of the control cord, this recess likewise being adapted to clamp the control cord.

4. A panel curtain system as claimed in claim 1, wherein the thickness of the central part (11) is smaller than the thickness of the guide elements (12, 13, 15) such that the control cord can cross the central part.

5. An operating runner as a component of a panel curtain system as claimed in claim 1, wherein the operating runner is adapted for guiding in the rail and is provided with means for attaching to at least one of the panels and with means for fastening the control cord, characterized in that the operating runner (10) comprises a tensioning element (15) for tensioning the control cord in the situation of use of the panel curtain system, wherein the tensioning element (15) is adapted to receive one of the outer ends of the control cord in releasably clamping manner, wherein the operating runner (10) is provided with a central part (11) which is provided on one side with a guide element (15) adapted for guiding in one of the runner channels of the rail, this guide element (15) comprising the tensioning element, wherein the central part (11) is provided on the opposite side with at least one further guide element (12, 13) which is adapted for guiding in one of the cord channels (21) of the rail and for passage of the control cord (5), wherein the tensioning element (15) comprises a recess (25) for receiving a first outer end (5-1) of the control cord, this recess being adapted to clamp the control cord, wherein the operating runner is arranged to be wholly received in the rail with said recess running adjacently of the longitudinal opening for the runners provided in said runner channel allowing the outer end to protrude from the runner channel making it accessible to a user.

* * * * *